US006311921B1

(12) United States Patent
Möller et al.

(10) Patent No.: US 6,311,921 B1
(45) Date of Patent: Nov. 6, 2001

(54) WINDING DEVICE AND METHOD FOR WINDING WEB MATERIAL

(75) Inventors: Roland Möller, Herbrechtingen; Werner Leitenberger, Schlier; Jörg Maurer, Steinheim, all of (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/422,237

(22) Filed: Oct. 21, 1999

(30) Foreign Application Priority Data

Oct. 22, 1998 (DE) ..... 198 48 816

(51) Int. Cl.[7] ..... B65H 18/22; B65H 18/26; B65H 20/06

(52) U.S. Cl. ..... 242/535.4; 242/541.3; 242/541.7; 242/542.3; 242/542.4

(58) Field of Search ..... 242/526.3, 535.4, 242/541.1, 541.3, 541.7, 542.3, 542.4

(56) References Cited

U.S. PATENT DOCUMENTS

| | | | | |
|---|---|---|---|---|
| 3,549,098 | * | 12/1970 | Helkala | 242/542.4 |
| 3,552,670 | * | 1/1971 | Herman | 242/532.7 |
| 4,143,828 | | 3/1979 | Braün et al. . | |
| 4,283,023 | | 8/1981 | Braun et al. . | |
| 5,515,619 | | 5/1996 | Kahl et al. | 34/114 |
| 5,531,396 | * | 7/1996 | Kinnunen et al. | 242/541.3 |
| 5,551,171 | | 9/1996 | Dahl . | |
| 5,713,534 | * | 2/1998 | McClenathan et al. | 242/542.3 |
| 5,823,463 | | 10/1998 | Fissmann et al. | 242/541.7 |
| 5,848,756 | | 12/1998 | Sollinger et al. | 242/412 |
| 5,967,449 | | 10/1999 | Thomas et al. | 242/541.1 |

FOREIGN PATENT DOCUMENTS

| | | |
|---|---|---|
| 4409036 | 9/1925 | (DE) . |
| 691282 | 5/1940 | (DE) . |
| 2721881 | 11/1978 | (DE) . |
| 2818777 | 9/1979 | (DE) . |
| 4103799 | 8/1992 | (DE) . |
| 4116068 | 11/1992 | (DE) . |
| 19647919 | 5/1998 | (DE) . |
| 19745005 | 7/1998 | (DE) . |
| 0640543 | 3/1995 | (EP) . |
| 0640716 | 3/1995 | (EP) . |
| 0658504 | 6/1995 | (EP) . |
| 0791550 | 8/1997 | (EP) . |
| 97/01502 | 1/1997 | (WO) . |

OTHER PUBLICATIONS

An English Language abstract of DE 41 03 799.
An English Language abstract of DE 44 09 036.
An English Language abstract of DE 41 16 068.

* cited by examiner

*Primary Examiner*—John M. Jillions
(74) *Attorney, Agent, or Firm*—Greenblum & Bernstein, P.L.C.

(57) ABSTRACT

Method for winding a material web onto a reel in an apparatus that includes a rotatable feed roll, a carrying drum, a discharge roll and a pulper. Winding device for winding a material web onto a reel, said winding device including: a feed roll, a carrying drum, and a support belt which is adapted to guide the material web over the feed roll and the carrying drum. An external vacuum device is positioned adjacent a circumferential surface of the carrying drum which is not contacted by the support belt and the material web and a winding nip is formed between the carrying drum and the reel. A discharge roll is provided for guiding the support belt, and the discharge roll is located in the vicinity of a pulper, downstream from the carrying drum, relative to a web run direction. The discharge roll is also adapted to divert at least a portion of the material web to the pulper before feeding the material web to the reel. The carrying drum may include at least one of circumferential ridges and perforations, and the support belt is one of a perforated and an air permeable belt. Preferably, the carrying drum includes a perforated jacket.

77 Claims, 5 Drawing Sheets

WINDING DEVICE AND METHOD FOR WINDING WEB MATERIAL

CROSS-REFERENCE TO RELATED APPLICATIONS

The present application claims priority under 35 U.S.C. §119 of German Patent Application No.198 48 816.5, filed Oct. 22, 1998, the disclosure of which is expressly incorporated by reference herein in its entirety.

BACKGROUND OF THE INVENTION

1. Field of the Invention

The present invention concerns a winding device and a method for winding a material web on a reel. The winding device includes a feed roll, a carrying frame, e.g., a carrying drum and a perforated support belt, and a reel upon which the material web is wound. A vacuum may be applied to hold the material web to the carrying fame. The method of the present invention relates to introducing the material web over a feed roll, guiding the material web by a perforated support belt over a suction carrying drum, and forming a winding nip (gap) between the carrying drum and a reel upon which the material web is wound.

2. Discussion of Background Information

EP-Bl-0 658504 discloses a winding device having a carrying drum with internal suction. The winding device may be used at the end of a machine for producing or refining a material web or may be used to rewind an already wound roll. Such a machine may be a paper machine. During operation, problems may occur particularly when the material web or a leading end of the material web, also referred to herein as the threading tip, is fed into a winding arrangement. Thus, it is conventional to have lead cables, blow plates, vacuum belts, and/or the like to transport the leading end of the material web to the carrying drum, after which the leading end may be guided around the carrying drum. Then, a doctor blade, such as a blow doctor, may remove the leading end of the material web from the carrying drum, and the leading edge may be guided with a blow wedge or the like, or may be diverted with a guide plate, into a pulper. The paper web is then broadly and continuously diverted into the pulper by, for example, a guide plate with a blower. Thereafter, the material web may be separated, i.e., cut, with a gooseneck, belt, knife, water jet, and/or the like and guided onto an empty reel which is made available. Sometimes the automatic feeding of the special strip-type leading end or of the entire material web on an empty reel or on an already wound roll may become uncontrollable. This often occurs with higher machine speeds and with grooved or perforated carrying drums, which are not provided with suction.

FIG. 1 depicts a prior art winding device 10. In device 10, a winding nip (gap) 18 is formed between carrying drum 12 and an empty reel 16'; three web paths, A, B and C are shown, with path A being desired and paths B and C being undesired. In desired web path A, the leading end of material web 14 is first released from carrying drum 12 by a doctor blade 20 and diverted into pulper 22. In web path B, the strip-type leading end of material web 14 or the entire width of material web 14 is guided over carrying drum 12 and wound directly downstream from winding nip (gap) 18 in an incontrolled manner upon empty reel 16'. In web path C, there is uncontrolled automatic feeding onto an already wound reel 16.

By providing a vacuum in carrying drum 12, the guidance of the usually strip-type leading end of the material web or the material web itself is controlled up to a discharge zone where a doctor blade 20 is provided so that automatic feeding upon empty reel 16' (web path B) may be avoided However, with a vacuum in the carrying drum, the web pickup by the doctor blade is made more difficult, and the material web may possibly feed in an uncontrolled manner onto a wound roll as in web path C.

Also, it is problematic in the known designs to have the web removed from a carrying drum with a coated surface (e.g. SiC), soft coating, and/or surface structures, such as, in particular, ridges, V-shaped grooves, or the like, because doctor blade contact is not possible. The leading end, i.e., the threading tip of material web 14, or the entire width of material web 14, must then be freed from the carrying drum with a blow knife, which also makes guidance of the web into the pulper more difficult. Moreover, with internal vacuum carrying drums whose interiors are completely subjected to a vacuum, it is possible for air to inadvertently penetrate into the part of the carrying drum not contacted by the web, which results, in particular, in relatively high energy consumption. On the other hand, carrying drums with inside seals have the disadvantage that the carrying drums have to be dismantled in order to change seals.

SUMMARY OF THE INVENTION

The present invention provides for a winding device in which the leading end of the material web or the material web is reliably guided independently of the respective position of the empty reel and in which the web material is reliably removed from the carrying drum regardless of the specific nature of its surface.

In the present invention, the carrying drum is provided with circumferential ridges and/or a perforated jacket which is subjected to an external vacuum in a circumferential region not contacted by the perforated support belt and the material web. Preferably, the leading end or the material web is supported by the support belt and fixed thereon by a vacuum from the interior side of the support belt.

In accordance with the present invention, the material web or its leading end or point is fixed continuously with a vacuum which is provided from the vicinity of the feed roll to the vicinity of the discharge roll, which is near the pulper, thus virtually eliminating uncontrolled automatic feeding. Without the necessity of a doctor blade, the support belt, reliably removes the web from the carrying drum. Since a vacuum fixes the material web on the carrying drum, a certain web tension may be present upstream from the winding device even with low nip pressures between the carrying drum and the reel. Since an external vacuum is applied to the carrying drum, the carrying drum does not need internal sealing fittings. Thus, it is not necessary to disassemble the carrying drum in order to change seals. Also with an external vacuum, it is now possible to apply a combined vacuum to the feed section, carrying drum, and discharge section. For example, with an appropriate external vacuum box, it is possible to provide a vacuum over the entire circumferential perforated surface of the carrying drum, thereby reducing the overall amount of vacuum to a minimum. With a corresponding support belt change, the respective winding characteristics are modifiable if necessary.

In an exemplary embodiment, the support belt comes into contact with the feed roll which is wound by the material web. The support belt picks up the material web in the region of the feed roll and may wind the feed roll in the pickup vicinity.

To improve the winding characteristics, the carrying drum and/or the support belt may have a structured surface. The structured surface may include a surface that has raised portions and recessed portions, a surface that has raised nodes that are spherical or cubical, or a surface that is channeled, corrugated, ribbed, grooved and the like. Preferably, the structured surface may have V-shaped grooves and/or the like.

Preferably, the support belt is a thin, flexible belt which is provided with a surface adapted to the surface of the carrying drum.

In principle, the support belt may be a cut support belt which is provided with a connecting seam as in drying wires or may be a continuous support belt. However, in the latter case, appropriate precautions must be taken to replace the belt. The support belt may, for example, have winding characteristics determined by hardness, by the modulus of elasticity, by roughness, and/or the like. In particular, the carrying drum may have perforations or alternatively may have both perforations and surface structures such as V-shaped grooves and/or the like.

In all exemplary embodiment of the winding device according to the present invention, the carrying drum malt be subjected to a vacuum by at least one external vacuum box. The vacuum box contains at least one vacuum port and is positioned opposite the circumferential surface of the carrying drum not contacted by the support belt and the material web. The vacuum box is sealed in the vicinity of the vacuum port by sealing elements cooperating with the carrying drum. Sealing elements running crosswise of the web travel direction may be provided on opposite sides of the vacuum port. These sealing members may preferably be doctor blades, which may preferably make flat contact with the carrying drum.

The vacuum box extends crosswise of the web travel direction preferably at least substantially across the entire machine width.

The vacuum box may preferably be supplied with a vacuum from an internally positioned tube provided with vacuum ports and connected to a vacuum source. The internally positioned tube preferably extends at least substantially across the entire machine width. The vacuum ports are provided in the jacket of the internally positioned tube and are preferably disposed on the side of the tube facing the carrying drum.

In another embodiment of the winding device according to the present invention, vacuum may be applied to the support belt in the vicinity between the feed roll and the carrying drum with a vacuum channel, which is formed between the internal side of the support belt, an adjacent side wall of the vacuum box near the feed roll and the carrying drum. Vacuum is applied to the feed side of the web as viewed in the web travel direction in the vicinity between the vacuum box and the support belt running off the carrying drum. The vacuum channel has a flexible seal on its front end as viewed in the web travel direction, which prevents the entry of the air boundary layer entrained by the support belt on the feed side.

It is also advantageous to apply vacuum to the support belt in the vicinity between the carrying drum and the discharge roll. This is done with a vacuum channel, which is formed between the interior side of the support belt, an adjacent side wall of the vacuum box near the discharge roll, and the carrying drum. The vacuum is applied at the discharge side of the web, as viewed in the web travel direction, in the vicinity between the vacuum box and the support belt being guided off the carrying drum. On the other end of the channel, the entrained air discharged with the support belt contributes to the generation of the vacuum. The compressed air in the vicinity of the discharge roll causes the strip-type leading end or the material web to be inevitably released from the support belt as the support belt winds on the discharge roll. In specific cases, it may also be preferable to provide a blowing device in the vicinity of the discharge roll in order to aid the release of the material web from the support belt.

The carrying drum and the vacuum box may be appropriately subdivided to form an edge vacuum zone provided in the vicinity of one of the two drum ends. For this purpose, the carrying drum and the vacuum box may, for example, have appropriate partitions on the leading side. Preferably, vacuum may be selectively applied to only the edge vacuum zone or the vacuum may be applied to the entire vacuum zone extending at least substantially across the entire machine width. Since at first vacuum is applied to only the edge vacuum zone in the carrying drum and the vacuum box, all accordingly high vacuum develops so that, independently of the respective position of a relevant empty reel, reliable transport of the leading end of the material web is always guaranteed.

In another embodiment of the winding device according to the present invention, the discharge roll may be adjustable. Advantageously, the discharge roll may be selectively movable and the support belt being guided off the carrying drum may wind the reel or the wound roll formed thereon. A corresponding partial winding of the reel by the support belt yields an additional winding parameter. Apart from supporting the web transfer to a new empty reel or a wound roll, the discharge roll forms a corresponding longitudinal nip (gap) with a low nip pressure which results in an optimal winding structure which may cooperate with the other winding parameters such as, in particular, carrying drum contact, web tension, the central drive, and/or the like.

The carrying drum is preferably displaceable and may be brought into contact with the reel or the wound roll formed thereon. In this case, the carrying drum is preferably mounted on a carrying drum sled which is adjustable relative to a displaceable base sled. The carrying drum may preferably be brought into contact with the reel or the wound roll formed thereon with the carrying drum sled displaceable relative to the base sled. For this purpose, the movement of the carrying drum sled relative to the base sled is preferably power controlled.

The increase in the winding diameter may be compensated at least partially by appropriate displacement of the base sled. This is particularly expedient when the reel is still positioned in a primary housing where the reel may be transferred, in particular from a winding position into a transfer position, in order to subsequently be further transported in a secondary housing. The movement of the base sled is preferably path controlled.

When the carrying drum is moveable, special web and belt guidance is useful. Thus, the feed roll is, or may be, advantageously positioned so that the forces exerted by the support belt and the material web on the carrying drum act at an angle of approximately 90° to the force with which the carrying drum contacts the reel or the wound roll formed thereon. This results, among other things, in the carrying drum slightly contacting the reel and the contact is virtually unaffected by any web or belt forces at all.

The feed roll and the discharge roll are preferably mounted on the base sled. Thus, despite the relatively great thrust of the base sled, it is guaranteed that the force directions do not change.

In another embodiment of the winding device according to present invention, the vacuum box is pivotably mounted around the axis of the carrying drum and is connected with the base sled by a coupling on the vacuum box's distal end from the carrying drum. The pivot points of the coupling are advantageously selected so that the seal of the vacuum box is retained even with a respective displacement of the carrying drum relative to the base sled. Likewise, the pivot points of the coupling are advantageously selected so that the seal of a feed side vacuum channel, which is formed by the sealing elements and possibly by a flexible seal, is retained, even with a respective displacement of the carrying drum relative to the base sled.

The present invention also provides for a winding device for winding a material web onto a reel, said winding device including: a feed roll, a carrying drum, and a support belt which is adapted to guide the material web over the feed roll and the carrying drum. An external vacuum device is positioned adjacent a circumferential surface of the carrying drum which is not contacted by the support belt and the material web and a winding nip is formed between the carrying drum and the reel. A discharge roll is provided for guiding the support belt, and the discharge roll is located in the vicinity, of a pulper, downstream from the carrying drum, relative to a web run direction. The discharge roll is also adapted to divert at least a portion of the material web to the pulper before feeding the material web to the reel.

The carrying drum mart include at least one of circumferential ridges and perforations, and the support belt is one of a perforated and an air permeable belt. Preferably, the carrying drum includes a perforated jacket. The support belt is adapted to support the material web, to hold the material web onto the support belt with the vacuum supplied by the external vacuum device and to pick up the material web in the vicinity of the feed roll. The support belt is arranged to wind on a portion of the feed roll.

At least one of the carrying drum and the support belt has a structured surface. The structured surface may include a surface that has raised portions and recessed portions, a surface that has raised nodes that are spherical or cubical, or a surface that is channeled, corrugated, ribbed, grooved and the like. Preferably, the structured surface has V-shaped grooves. The support belt may be a thin, flexible belt that is adapted to the structured surface of the carrying drum.

The external vacuum device may include at least one external vacuum box and at least one vacuum port; and may have sealing elements located in a vicinity of the at least one vacuum port and coupled with the carrying drums. The sealing elements may be arranged to extend crosswise to the web travel direction and may be provided on opposite sides of the vacuum port. Preferably, the sealing elements are doctor blades which are arranged to make flat contact with the carrying drum.

The at least one external vacuum box may also be arranged to extend crosswise to the web travel direction and at least substantially across an entire width of the winding device. The at least one vacuum box may include an internally positioned tube having the at least one vacuum port connected to a vacuum source. The internally positioned tube may be arranged to extend at least substantially across an entire width of the winding device. The internally positioned tube may include a jacket having vacuum ports disposed on the side of the jacket facing the carrying drum.

The winding device may further include the at least one external vacuum box including at least one side wall positioned to face the support belt between the feed roll and the support roll. A feed side vacuum channel may be located between the feed roll and the carrying drum and formed beneath the surface of the support belt adapted to carry the material web between the interior side of the support belt, the adjacent side wall of the at least one vacuum box near the feed roll, and the carrying drum. Vacuum is applied to the interior side of the support belt through the carrying drum. The feed side vacuum channel may be bounded at its front end, as viewed in the web travel direction, by a flexible seal.

The winding device may further include the at least one external vacuum box including at least one side wall positioned to face the support belt between the carrying drum and the discharge roll. A discharge side vacuum channel may be located between the carrying drum and the discharge roll and formed beneath a surface of the support belt adapted to carry the material web between the interior side of the support belt the adjacent side wall of the at least one vacuum box near the discharge roll, and the carrying drum. Vacuum is applied to the interior side of the web through the carrying drum.

The winding device may also include a blowing device located in the vicinity of the discharge roll to assist the release of the material web from the support belt.

The winding device may also include an edge vacuum zone, located in the vicinity of an end of the carrying drum and formed by subdividing an area enclosed by the carrying drum and the at least one external vacuum box, which may further include an internally positioned tube for applying vacuum to the edge vacuum zone.

The discharge roll may be positionally adjustable and the carrying drum may be movable and may be adapted to be pressed against the reel or the wound roll formed thereon.

The winding device may further include a base sled, wherein the carrying drum is mounted on the base sled and is adjustable relative to the movement of the base sled and the carrying drum may be pressed against one of the reel and the wound roll by the movement of the carrying drum sled. The moveable carrying drum sled may be a power controlled sled and may be adapted to move to at least partially compensate for an increasing winding diameter of the wound reel. The movable base sled may be path controlled.

The feed roll and the discharge roll may be positioned so that the support belt and the material web exert a force on the carrying drum that acts at an angle of approximately 90° to the force with which the carrying drum is pressed against one of the reel and the wound roll.

The winding device may further include a base sled, wherein the feed roll and the discharge roll are mounted on the base sled. The at least one vacuum box may be pivotably mounted around a central axis of the carrying drum and further include a coupling connecting the base sled with the at least one vacuum box. Further, pivot points may be located in the coupling so that the seal of the vacuum box is maintained during the relative movement between the carrying drum and the base sled. The carrying drum also may be provided with a zone-controlled internal support.

The present invention also includes a winding device which may further include the vacuum device including at least one external vacuum box and having at least one vacuum port. Sealing elements may be provided in the vicinity of the at least one vacuum port coupled with the caring drum. A tube may be positioned inside of the at least one vacuum box and connected to a vacuum source. The at least one external vacuum box may include at least one side wall positioned to face the support belt between the feed roll and the support roll. A feed side vacuum channel, as described above, may be located between the feed roll and the carrying drum. The at least one external vacuum box may include at least one side wall positioned to face the support belt between the carrying drum and the discharge roll. A discharge side vacuum channel, as described above, may be located between the carrying drum and the discharge roll. The winding device may further include a blowing device located in the vicinity of the discharge roll to assist the release of the material web from the support belt.

The aforementioned device may further include a base sled, wherein the carrying drum is mounted on the base sled and is adjustable relative to the movement of the base sled and is pressed against the reel or the wound roll thereon by the movement of the carrying drum sled.

The device, on the other hand, may further include a base sled adapted to mount the feed roll and the discharge roll, a coupling connecting the base sled with the at least one vacuum box; and pivot points located in the coupling, wherein the at least one vacuum box is pivotably mounted around a central axis of the carrying drum and the seal of the vacuum box is retained during the relative movement between the carrying drum and the base sled.

The present invention also provides for a method for winding a material web onto a reel in an apparatus that includes a rotatable feed roll, a carrying drum, a discharge roll and a pulper.

The method includes: introducing a material web over a rotating feed roll, guiding the material web from the rotating feed roll to the carrying drum, guiding the material over the carrying drum on a support belt, and applying an external vacuum to a circumferential surface of the carrying drum, which is not contacted by the support belt. A winding nip is formed between the carrying drum and the reel and the support belt is guided over the discharge roll, which is located downstream from the carrying drum, relative to the belt run direction, in the vicinity of a pulper. A leading end of the material web is guided into the pulper, and thereafter the material web is wound onto the reel.

The carrying roll may have at least one of circumferential ridges and perforations, and the support belt may be one of a perforated and an air permeable belt. The carrying drum preferably may have a perforated jacket.

The method further includes supporting the material web on the support belt and fixing the material web on the support belt by vacuum. The method also includes guiding the material web on the feed roll, picking up the material web with the support belt in the vicinity of the feed roll and guiding the support belt over the feed roll in a pickup vicinity. At least one of the carrying drum and the support belt may have a structured surface. The structured surface may include a surface that has raised portions and recessed portions, a surface that has raised nodes that are spherical or cubical, or a surface that is channeled, corrugated, ribbed, grooved and the like. Preferably, the structured surface may have V-shaped grooves. The support belt may be a thin, flexible belt and conforms to the structure of the carrying drum.

Vacuum may be applied from at least one external vacuum box opposite the peripheral vicinity of the carrying drum not contacted by the support belt and the material web; the at least one vacuum box having at least one vacuum port and having sealing elements in the vicinity of the at least one vacuum port contacting the carrying drum. The sealing elements may extend crosswise of the web travel direction and may be located on opposite sides of the vacuum port, and the sealing elements may be doctor blades which make flat contact with the carrying drum.

The at least one external vacuum box may extend crosswise of the web travel direction at least substantially across the entire width of the machine. Vacuum may also be applied from an internally positioned tube having the at least one vacuum port, the tube being inside the at least one external vacuum box. The internally positioned tube may extend at least substantially across the entire width of the winding device and may have a jacket having the at least one vacuum port on the side of the tube facing the carrying drum.

The method also includes forming a feed side vacuum channel located between the feed roll and the carrying drum, wherein the interior side of the support belt faces a side of the at least one vacuum box and the exterior side of the support belt faces the material web, and applying vacuum through the feed side vacuum channel to the interior side of the support belt in the vicinity between the feed roll and the carrying drum. The feed side vacuum channel may be bounded at its front end, as viewed in the web travel direction, by a flexible seal.

The method also includes forming a discharge side vacuum channel located between the discharge roll and the carrying drum, wherein the interior side of the support belt faces a side of the at least one vacuum box and the exterior side of the support belt faces the material web, and applying vacuum through the discharge side vacuum channel to the interior side of the support belt in the vicinity between the carrying drum and the discharge roll. Compressed air may be blown in the vicinity of the discharge roll to assist the release of the material web from the support belt.

The method also provides for forming an edge vacuum zone, located in the vicinity of an end of the carrying drum by subdividing an area enclosed by the carrying drum and the at least one external vacuum box and applying the vacuum from the edge vacuum zone. The at least one vacuum box further includes an internally positioned tube for applying vacuum to the edge vacuum zone.

The discharge roll may be moved to feed the leading end of the material web to the pulper and thereafter moved to feed the material web onto the reel.

The carrying drum may be moved to press against at least one of the reel and the wound roll. Preferably, the carrying drum is mounted on a base sled and the carrying drum base sled is moved to cause the carrying drum to press against at least one of the reel and the bound roll. The moveable carrying drum base sled may be a powered controlled sled. Also the moveable carrying drum base sled may be moved to at least partially compensate for an increasing winding diameter of the wound roll and may be moved along a controlled path.

The method also includes positioning the feed roll and the discharge roll so that the support belt and the material web exert a force on the carrying roll that acts at an angle of approximately 90° to the force with which the carrying drum is pressed against one of the reel and the wound roll.

The feed roll and the discharge roll may be mounted on a base sled. The vacuum may be pivoted around the axis of the carrying drum and a coupling may connect the base sled to the vacuum box at an end remote from the carrying drum. The coupling may have pivots points so that the seal of the vacuum box is maintained during relative movement between the carrying drum and the base sled. The carrying drum may also be provided with a zone-controlled internal support.

The method also includes applying a vacuum from at least one external vacuum box opposite the peripheral vicinity of the carrying drum not contacted by the support belt and the material web. The at least one vacuum box may have at least one vacuum port and may have sealing elements in the vicinity of the at least one vacuum port contacting the carrying drum. Vacuum may be applied from an internally positioned tube having the at least one vacuum port, the tube being inside the at least one external vacuum box.

A feed side vacuum channel may be formed such that it is located between the feed roll and the carrying drum, wherein the interior side of the support belt faces a side of the at least one vacuum box and the exterior side of the support belt faces the material web and vacuum may be applied through the feed side vacuum channel to the interior side of the support belt in the vicinity between the feed roll and the carrying drum.

A discharge side vacuum channel may be formed between the discharge roll and the carrying drum, wherein the interior side of the support belt faces a side of the at least one vacuum box and the exterior side of the support belt faces the material web and vacuum may be applied through the discharge side vacuum channel to the interior side of the support belt in the vicinity between the carrying drum and the discharge roll. Compressed air may be blown in the vicinity of the discharge roll to assist the release of the material web from the support belt.

The method also provides for mounting the carrying drum on a base sled and moving the base sled to cause the carrying drum to press against at least one of the reel and the bound roll.

The method also provides for mounting the feed roll and the discharge roll on a base sled, pivoting the vacuum box around the axis of the carrying drum and connecting the base sled with a coupling to the vacuum box at an end remote from the carrying drum; wherein the coupling has pivots points so that the seal of the vacuum box is maintained during relative movement between the carrying drum and the base sled.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
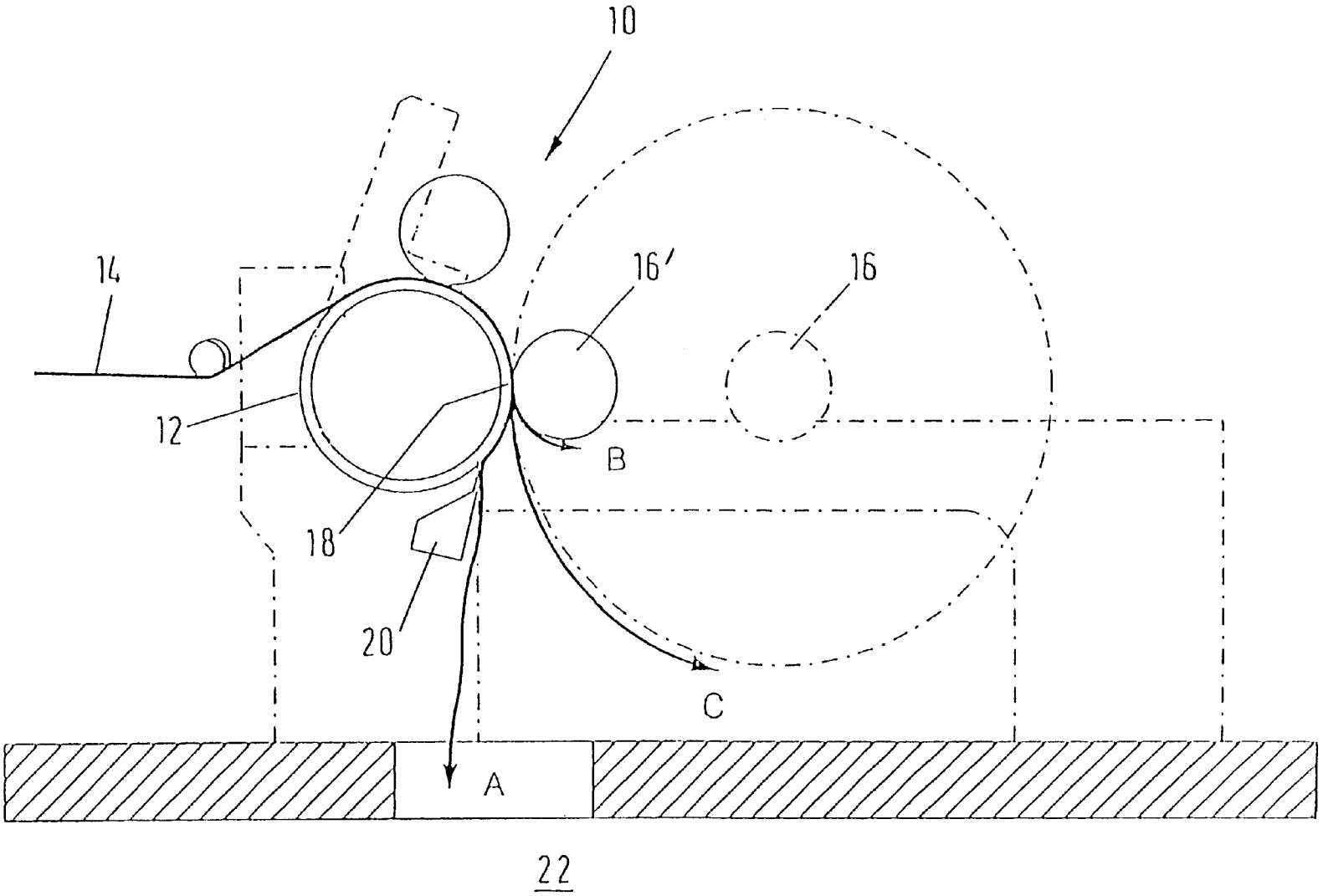
Fig. 1 Prior Art
FIG. 1 illustrates a prior art winding machine with an internal vacuum carrying drum.
Figure 2:
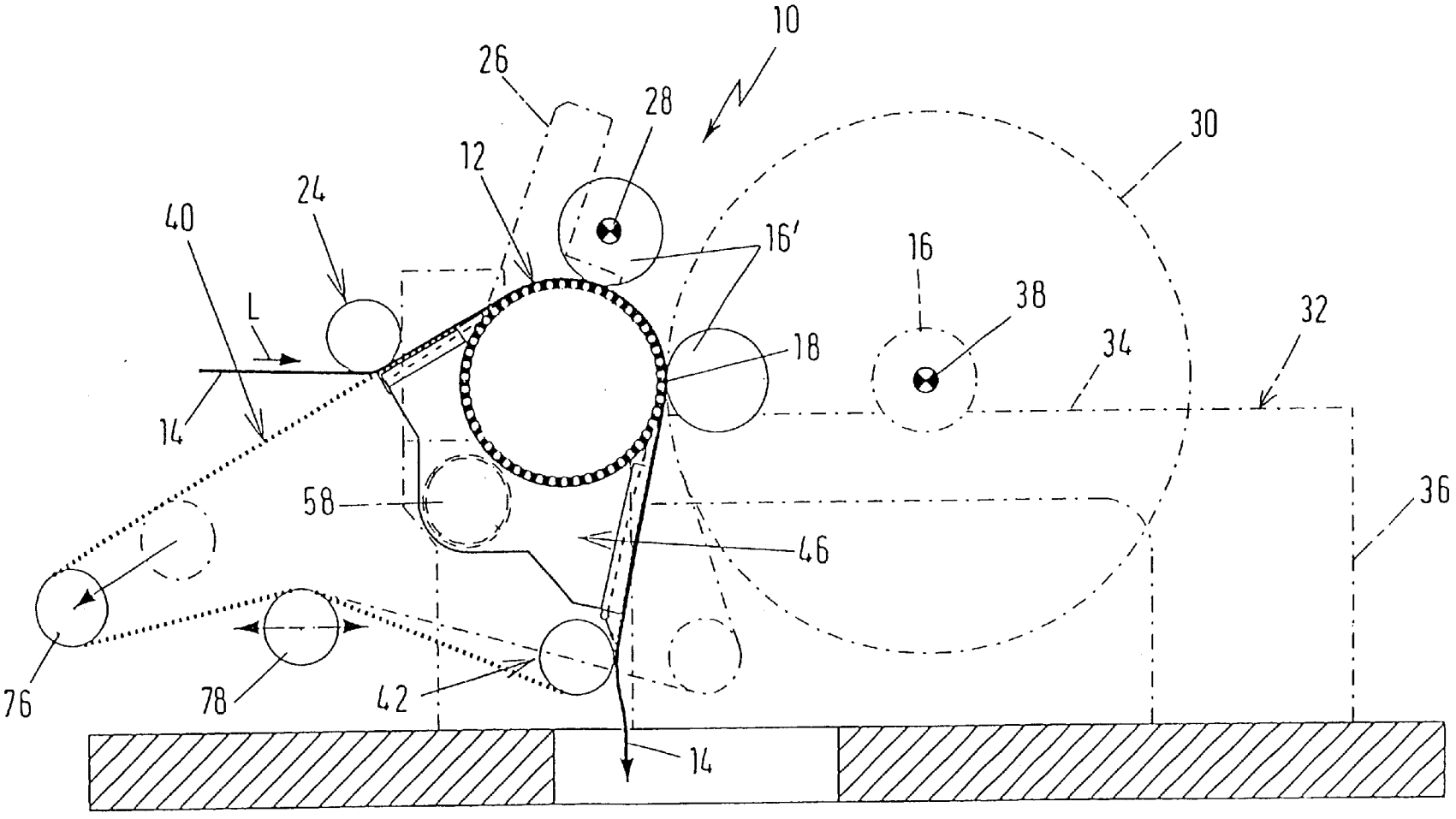
FIG. 2 illustrates one embodiment of the winding device according to the present invention.
Figure 3:
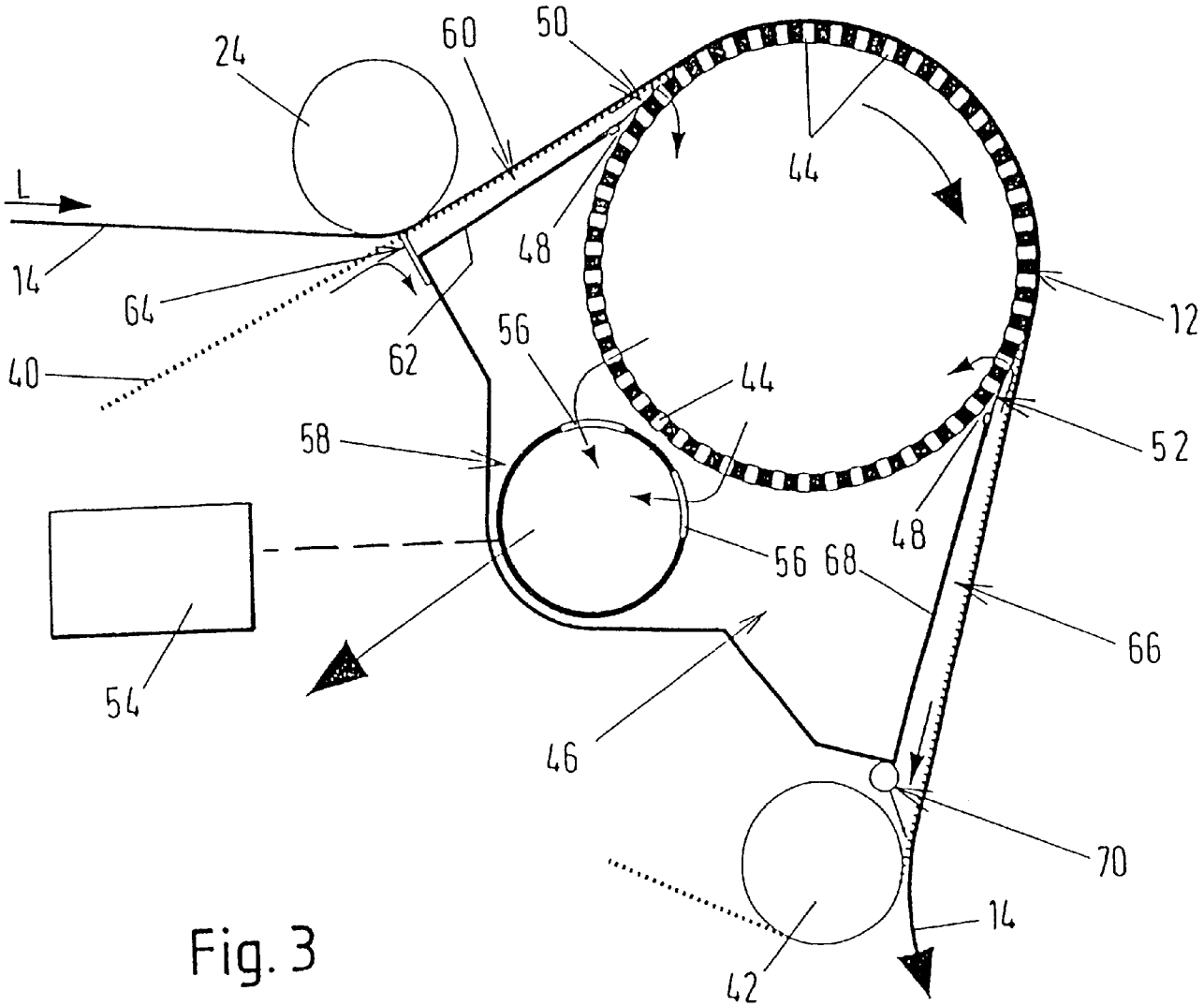
FIG. 3 is an enlarged depiction of the vacuum box associated with the carrying drum as well as the vacuum channels formed between it and the support belt of the winding device illustrated in FIG. 2.

FIGS. 2 and 3 depict a first exemplary embodiment of a winding device 10 according to the present invention for winding a material web 14 onto a reel 16. Material web 14 may be a paper or cardboard web. The winding device may be provided particularly at the end of an associated paper machine.

To produce a wound roll 30, material web 14 is guided over a feed roll 24 and then over a carrying drum 12 which forms a winding nip (gap) 18 with an empty reel 16' or corresponding wound roll 30 of an already wound reel 16. Carrying drum 12 and wound roll 30 are kept in contact with each other during the winding process in order to maintain this winding nip (gap) 18.

In a primary housing 26, the next, still empty reel 16' is held ready. Primary drive 28 may control reel 16' and may make the reel rotate in primary housing 26. Primary drive 28 may be moved along a first guide path defined by primary housing 26.

Winding device 10 also includes a secondary housing 32, which, for example, may have a transport device movable on a linear guide. The transport device holds and guides a respective reel 16. Rails 34, only one of which is shown in FIG. 2, may be provided. Rails 34 are disposed parallel to the horizontal and attached to a machine frame 36. Thus, if a reel 16 provided with mounting units were placed on rails 34, rails 34 would accommodate the weight of reel 16 or wound roll 30.

Thus, wound roll 30 may be moved by an appropriate transport device along a second guide path, which runs substantially horizontally and parallel to rails 34 as shown in FIG. 2, which depicts wound roll 30 and associated reel 16.

Secondary drive 38 may control reel 16 and may make it rotate within secondary housing 32. Secondary drive 38, which serves as a central drive, may be moved along the second guide path parallel to rails 34.

Carrying drum 12, which may again be driven with a central drive, then acts as a contact drum such that it is movable parallel to rails 34 of secondary housing 32 with a guide sled. Then, carrying drum 12 and wound roll 30 with an associated reel 16 are driven in the same plane.

The nip pressure in winding nip (gap) 18 may be controlled as desired by adjusting the appropriate contact of carrying drum 12 with reel 16 or wound roll 30 formed thereon. As the winding diameter of the wound roll increases, an appropriate compensation may be made for the increased diameter by, for instance, displacing the wound roll along rails 34. When reel 16' is still positioned in primary housing 26, carrying drum 12 may be moved appropriately to compensate for the increasing winding diameter.

As may be seen in FIGS. 2 and 3, material web 14 introduced over feed roll 24 is guided along with a perforated support belt 40 over carrying drum 12 and through winding nip (gap) 18. After carrying drum 12, perforated support belt 40 is guided over a discharge roll 42, which is disposed above a pulper 22, into which leading end 14) i.e, a leading point) or entire material web 14 is diverted before subsequent guidance onto reel 16'.

Carrying drum 12 has a perforated jacket, through whose holes or bores 44 a vacuum is applied from he outside in the circumferential zone of the carrying drum not contacted by perforated support belt 40 and material web 14 (see, in particular FIG. 3).

According to FIGS. 2 and 3, perforated support belt 40 supports and fixes thereon by vacuum the leading end or material web 14 from feed roll 24 all the way to discharge roll 42 before the leading end or material web 14 is subsequently guided onto reel 16' or 16. The vacuum is applied to the inward side of support belt 40

Perforated support belt 40 is in contact with feed roll 24, wound by material web 14, and then picks up material web 14 in the vicinity of feed roll 24. While in this embodiment perforated support belt 40 is guided tangentially, perforated support belt 40 may also partially wind around feed roll 24 in the pickup vicinity.

An external vacuum box 46 supplies a vacuum to carrying drum 12. Vacuum box 46 is disposed within the loop of perforated support belt 40 and is positioned opposite the circumferential vicinity of carrying drum 12 not contacted by support belt 40 and material web 14. A vacuum port 48 is provided in the vicinity where perforated support belt 40 is sealed by sealing elements cooperating with carrying drum 12. See FIG. 3, which depicts sealing elements 50 and 52 in the form of doctor blades running on opposite sides of vacuum port 48 crosswise of the direction travel of web L and flatly contacting carrying drum 12.

Vacuum box 46 extends crosswise of the direction travel of web L at least substantially across the entire machine width. An internally positioned tube 58 provided with vacuum ports 56 and connectable to a vacuum source 54 provides a vacuum to vacuum box 46. Again, this internal tube 58 also extends at least substantially across the entire machine width. As shown in FIG. 3, vacuum ports 56 provided in the jacket of tube 58 are disposed on the tube side facing carrying drum 12.

FIG. 3 also shows a vacuum channel 60 which is formed between the inward side of support belt 40 and an adjacent side wall 62 of vacuum box 56 and which supplies vacuum to support belt 40 in the vicinity between feed roll 24 and carrying drum 12. Carrying drum 12 may supply a vacuum to vacuum channel 60 in its back end as viewed in the web travel direction L in the vicinity between sealing element 50 and support belt 40 running onto carrying drum 12. At its front end as viewed in the web travel direction L, vacuum channel 60 is bounded by a flexible seal 64. Flexible seal 64 with support of belt 40 prevents an entrained air boundary layer from entering vacuum channel 60.

In the zone between carrying drum 12 and discharge roll 42, vacuum channel 66, which is formed between the inward side of support belt 40 and an adjacent side wall 68 of vacuum box 46, supplies a vacuum to support belt 40. The carrying drum may supply a vacuum to the additional vacuum channel 66 at its front end, as viewed in the direction of travel the web L, in the vicinity between sealing element 52 and support belt 40 running off carrying drum 12. In addition, the movement of support belt 40 brings out the entrained air, thus contributing to the generation of a vacuum in vacuum channel 66. As support belt 40 winds on discharge roll 42, compressed air in the vicinity of discharge roll 42 inevitably releases the leading end or material web 14 from perforated support belt 40.

In some embodiments, a blowing device 70 may assist in releasing material web 14 from support belt 40. Such a blowing device 70 is disposed in the vicinity of discharge roll 42 and may include, for example, a plurality of air jets. The blowing device may be formed, for example, by a blow tube with a plurality of blow ports extending crosswise of the direction travel of web L.

To form an edge vacuum zone provided on the leading side, carrying drum 12 and vacuum box 46 may be appropriately subdivided by partitions or the like. In this embodiment, internally positioned tube 58 supplies preferably a vacuum to either only the edge vacuum zone or the entire vacuum zone extending at least substantially across the entire machine width.

FIG. 2 also shows that discharge roll 42 is movable for assisting the web transfer to new empty reel 16' as well as for selectively optimizing further winding operations such as positioning the support belt so that it winds off carrying drum 12 and winds reel 16' or wound roll 30 formed thereon. The longitudinal gap with low nip pressure enables optimum winding structure in coordination with the other winding parameters such as in particular the carrying drum pressure, the web tension, the central drive, and/or the like. Support belt 40 is guided around or over additional adjustable deflecting rolls 76, 78, which may adjust the belt tension in particular and may compensate for a corresponding displacement of discharge roll 42. Discharge roll 42 deflects support belt 40 by approximately 90° generally in the horizontal direction.

Figure 4:
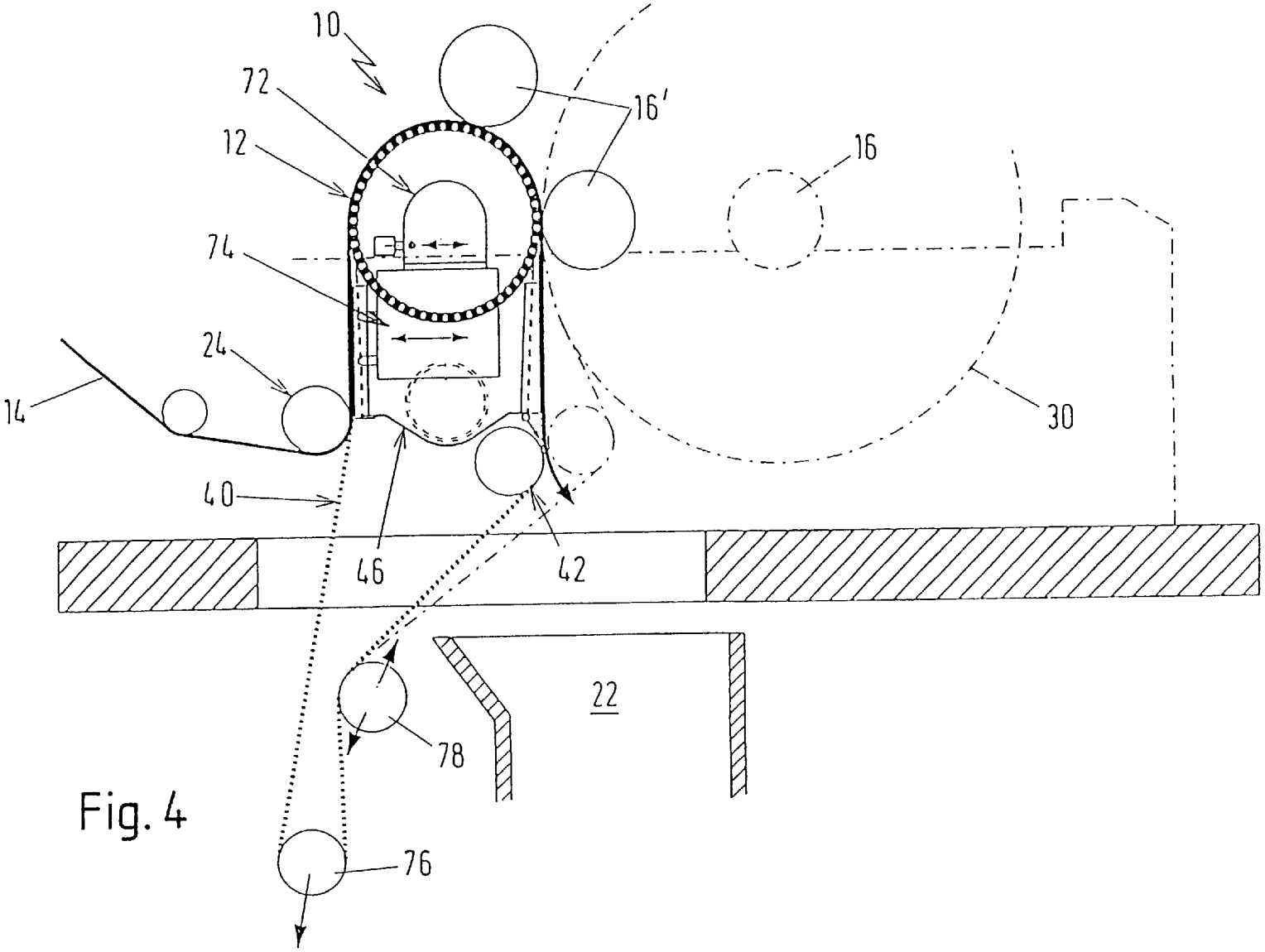
FIG. 4 illustrates another embodiment of the winding device according to the present invention.

In the embodiment according to FIG. 4, carrying drum 12 is movable and may be brought into contact with reel 16' or wound roll 30 formed thereon. In this embodiment. Carrying drum 12 is mounted on a carrying drum sled 72, which is movable relative to a traveling base sled 74. Carrying drum sled 72 moves relative to base sled 74 and brings carrying drum 12 into contact with reels 16, 16' or wound roll 30 formed thereon. The movement of carrying drum sled 72 relative to base sled 74 is power controlled and requires only a short thrust which may amount, for example, to approximately ±30 mm. With this carrying drum sled 72, carrying drum 12 may with little force be brought into contact with reel 16.

In contrast, the increase in the winding diameter is at least partially compensated by an appropriate displacement of base sled 74. The compensation with base sled 74 occurs expediently when carrying drum 12 is still positioned in primary housing 26 (see FIG. 2), in which the carrying drum is movable between a winding position and a pickup position, where the roll then may be picked up by secondary housing 32. In a second phase, after the pickup into secondary housing 32, the increase in winding diameter is expediently compensated by an appropriate displacement of wound roll 30 with associated reel 16 along rails 34 associated with secondary housing 32.

The movement of base sled 74 is path controlled and the sled may move up to, for example, approximately 500 mm.

For the embodiment with a movable carrying drum 12, special web and belt guidance are preferably provided, so that carrying drum 12 lightly contacts reel 16' or wound roll 30 formed on such a reel 16 and is influenced as little as possible by the corresponding web or belt forces. For this purpose, in the embodiment according to FIG. 4, feed roll 24 and discharge roll 42 are positioned or may be positioned so that the forces exerted by support belt 40 and material web 14 on carrying drum 12 act at an angle of approximately 90° to the force with which carrying drum 12 is in contact with reels 16, 16' or wound roll 30 formed thereon. To ensure that the directions of force do not change despite the relatively great thrust of base sled 74, feeder roll 24 and discharge roll 42 are mounted on base sled 74.

Support belt 40 is guided around or over additional movable deflecting rolls 76 and 78, with which the belt tension is particularly adjustable and compensates a corresponding displacement of discharge roll 42. In addition, with these deflecting rolls 76, 78, belt guidance is guaranteed so that the leading end of material web 14 or entire material web 14 may be diverted after release from support belt 40 in the vicinity of discharge roll 42 unhindered into pulper 42. Then, support belt 40 is deflected downward by discharge roll 42 at an angle to the intake opening of pulper 22.

Moreover, the embodiment shown in FIG. 4 may have the same structure as the embodiment shown in FIGS. 2 and 3. Corresponding parts are assigned the same reference characters.

Figure 5:
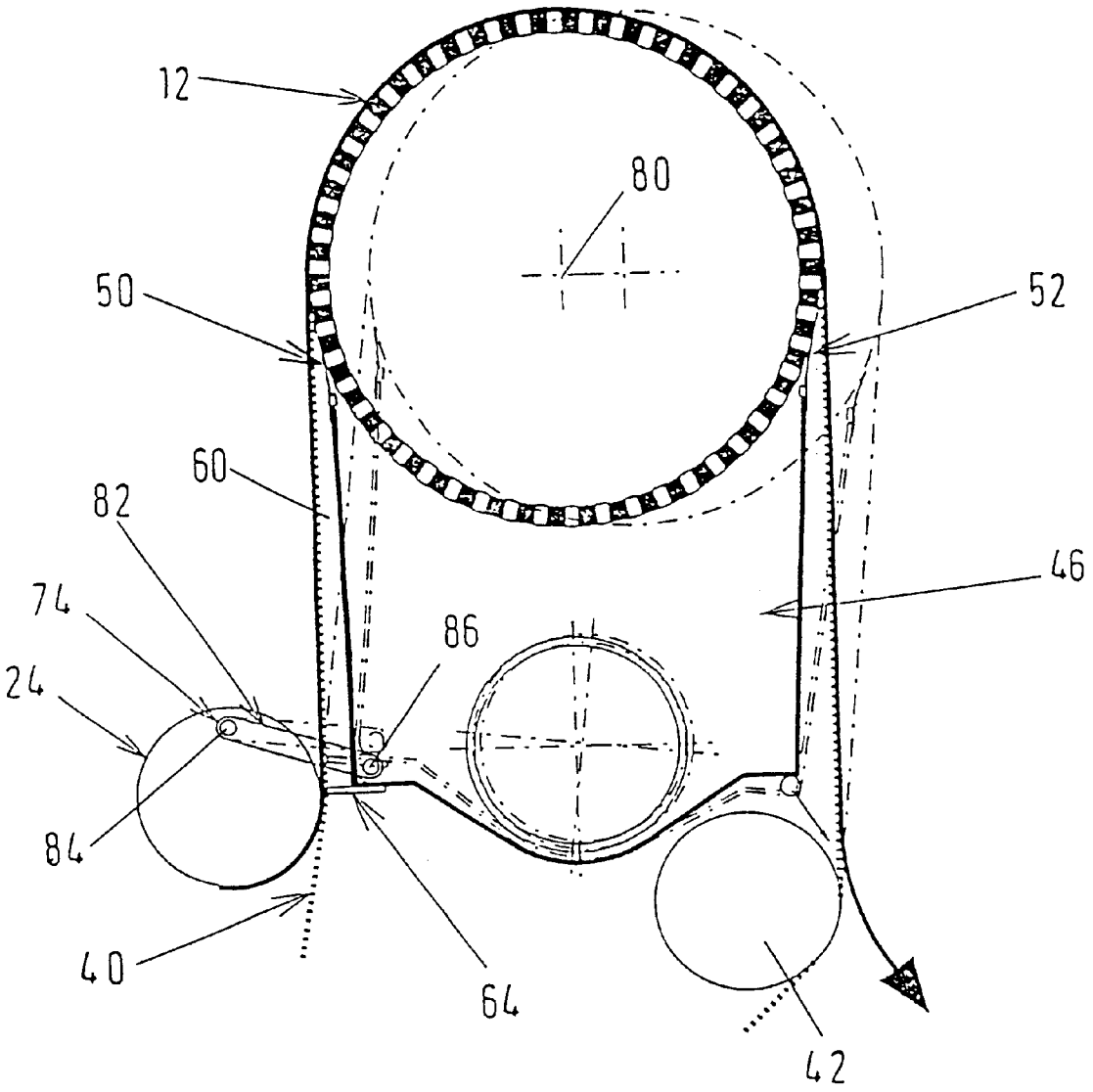
FIG. 5 illustrates another embodiment of the winding machine according to the present invention with vacuum boxes pivotably mounted around the axis of the carrying drum.

FIG. 5 shows another embodiment of winding device 10, in which parts which correspond to those of the preceding embodiments are again assigned the same reference characters.

The embodiment according FIG. 5 differs from that of FIG. 4 in that vacuum box 46 is rotatably mounted around axis 80 of carrying drum 12 and is connected on its distal end from carrying drum 12 by a coupling 82 with base sled 74.

Pivot points 84 and 86 of coupling 82 are selected so that the seal of vacuum box 46 or of feed-side vacuum channel 60 is maintained, even with a respective movement of carrying drum 12 relative to base sled 74. As shown in FIG. 5, vacuum box 46 is sealed with sealing elements 50 and 52 and flexible seal 64; the feed-side vacuum channel is sealed with sealing element 50 and flexible seal 64.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

LIST OF REFERENCE CHARACTERS

10 Winding device
12 Carrying drum
14 Material web
16 Wound reel
16' Empty reel
18 Winding nip (gap)
20 Doctor blade
22 Pulper
24 Feed roll
26 Primary housing
28 Primary drive
30 Wound roll
32 Secondary housing
34 Rails
36 Machine frame
38 Secondary drive
40 Perforated support belt
42 Discharge roll
44 Holes
46 Vacuum box
48 Vacuum port
50 Sealing element
52 Sealing element
54 Vacuum source
56 Vacuum ports
58 Tube
60 Vacuum channel
62 Side wall
64 Flexible seal
66 Vacuum channel
68 Side wall
70 Blowing device
72 Carrying drum sled
74 Base sled
76 Deflecting roll
78 Deflecting roll
80 Axis
82 Coupling
84 Pivot point
86 Pivot point

What is claimed is:

1. A winding device for winding a material web onto a reel to form a wound roll, said winding device comprising:

a feed roll;

a carrying drum movable relative to at least one of the reel and the wound roll and adapted to be pressed against the at least one of the reel and the wound roll;

a support belt being adapted to guide the material web over the feed roll and the carrying drum;

an external vacuum device positioned adjacent a circumferential surface of the carrying drum which is not contacted by the support belt and the material web;

a winding nip formed between the carrying drum and the at least one of the reel and the wound roll;

a discharge roll for guiding the support belt, the discharge roll being located in the vicinity of a pulper, and downstream from the carrying drum, relative to a web run direction; and the discharge roll being adapted to divert at least a portion of the material web to the pulper before feeding the material web to the at least one of the reel and the wound roll.

2. The winding device according to claim 1, wherein the carrying drum comprises at least one of circumferential ridges and perforations, and the support belt is one of a perforated and an air permeable belt.

3. The winding device according to claim 2, wherein the carrying drum comprises a perforated jacket.

4. The winding device according to claim 3, wherein the support belt is adapted to support the material web and to hold the material web onto the support belt with the vacuum.

5. The winding device according to claim 4, wherein the support belt is adapted to pick up the material web in the vicinity of the feed roll.

6. The winding device according to claim 5, wherein the support belt is arranged to wind on a portion of the feed roll.

7. The winding device according to claim 1, wherein at least one of the carrying drum and the support belt has a structured surface.

8. The winding device according to claim 7, wherein the structured surface comprises V-shaped grooves.

9. The winding device according to claim 7, wherein the support belt is a thin, flexible belt that is adapted to the structured surface of the carrying drum.

10. The winding device according to claim 1, the external vacuum device comprising at least one external vacuum box and at least one vacuum port; and further comprising:

sealing elements located in a vicinity of the at least one vacuum port and coupled with the carrying drum.

11. The winding device according to claim 10, wherein the sealing elements are arranged to extend crosswise to the web travel direction and are provided on opposite sides of the vacuum port; and the sealing elements are doctor blades arranged to make flat contact with the carrying drum.

12. The winding device according to claim 10, wherein the at least one external vacuum box is arranged to extend crosswise to the web travel direction and at least substantially across an entire width of the winding device.

13. The winding device according to claim 10, the at least one vacuum box comprising an internally positioned tube having the at least one vacuum port connected to a vacuum source.

14. The winding device according to claim 13, wherein the internally positioned tube is arranged to extend at least substantially across an entire width of the winding device.

15. The winding device according to claim 14, wherein the internally positioned tube includes a jacket having vacuum ports disposed on the side of the jacket facing the carrying drum.

16. The winding device according to claim 10, further comprising:

the at least one external vacuum box including at least one side wall positioned to face the support belt between the feed roll and the support roll;

a feed side vacuum channel located between the feed roll and the carrying drum and formed beneath the surface of the support belt adapted to carry the material web between the interior side of the support belt, the adjacent side wall of the at least one vacuum box near the feed roll, and the carrying drum, and wherein vacuum is applied to the interior side of the support belt through the carrying drum.

17. The winding device according to claim 16, wherein the feed side vacuum channel is bounded at its front end, as viewed in the web travel direction, by a flexible seal.

18. The winding device according to claim 10, further comprising:

the at least one external vacuum box including at least one side wall positioned to face the support belt between the carrying drum and the discharge roll;

a discharge side vacuum channel located between the carrying drum and the discharge roll and formed beneath a surface of the support belt adapted to carry the material web between the interior side of the support belt, the adjacent side wall of the at least one vacuum box near the discharge roll, and the carrying drum, and wherein vacuum is applied to the interior side of the web through the carrying drum.

19. The winding device according to claim 10, further comprising:

a blowing device located in the vicinity of the discharge roll to assist the release of the material web from the support belt.

20. The winding device according to claim 10, further comprising:

an edge vacuum zone, located in the vicinity of an end of the carrying drum and formed by subdividing an area enclosed by the carrying drum and the at least one external vacuum box.

21. The winding device according to claim 20, the at least one vacuum box further comprising an internally positioned tube for applying vacuum to the edge vacuum zone.

22. The winding device according to claim 10, wherein the discharge roll is positionally adjustable.

23. The winding device according to claim 10, further comprising:

a base sled, wherein the carrying drum is movably mounted on the base sled.

24. The winding device according to claim 23, wherein the carrying drum is pressed against one of the reel and the wound roll by the movement of the moveable carrying drum base sled.

25. The winding device according to claim 23, wherein the moveable carrying drum base sled is a power controlled sled.

26. The winding device of claim 23, wherein the movable carrying drum base sled is adapted to move at least to partially compensate for an increasing winding diameter of the wound reel.

27. The winding device of claim 26, wherein movement of the base sled is controlled along a predetermined path.

28. The winding device according to claim 27, wherein the feed roll and the discharge roll are positioned so that the support belt and the material web exert a force on the carrying drum that acts at an angle of approximately 90° to the force with which the carrying drum is pressed against one of the reel and the wound roll.

29. The winding device according to claim 10, further comprising:

a base sled, wherein the feed roll and the discharge roll are mounted on the base sled.

30. The winding device according to claim 29, wherein the at least one vacuum box is pivotably mounted around a central axis of the carrying drum and further comprises:

a coupling connecting the base sled with the at least one vacuum box at an end remote from the carrying drum.

31. The winding device according to claim 30, further comprising;

pivot points located in the coupling so that the seal of the vacuum box is maintained during the relative movement between the carrying drum and the base sled.

32. The winding device according to claim 10, wherein the carrying drum is provided with a zone-controlled internal support.

33. The winding device according to claim 1, further comprising:

the vacuum device including at least one external vacuum box and having at least one vacuum port;

sealing elements in the vicinity of the at least one vacuum port coupled with the carrying drum;

a tube, positioned inside of the at least one vacuum box and connected to a vacuum source;

the at least one external vacuum box including at least one side wall positioned to face the support belt between the feed roll and the support roll;

a feed side vacuum channel located between the feed roll and the carrying drum and formed beneath the surface of the support belt adapted to carry the material web between the interior side of the support belt, the adjacent side wall of the at least one vacuum box near the feed roll, and the carrying drum, the feed side vacuum channel being bounded at its front end as viewed in the web travel direction by a flexible seal and wherein vacuum is applied to the interior side of the support belt through the carrying drum;

the at least one external vacuum box including at least one side wall positioned to face the support belt between the carrying drum and the discharge roll;

a discharge side vacuum channel located between the carrying drum and the discharge roll and formed beneath a surface of the support belt adapted to carry the material web between the interior side of the support belt, the adjacent side wall of the at least one vacuum box near the discharge roll, and the carrying drum, and wherein vacuum is applied to the interior side of the web through the carrying drum; and a blowing device located in the vicinity of the discharge roll to assist the release of the material web from the support belt.

34. The winding device according to claim 33 further comprising:

a base sled, wherein the carrying drum is mounted on the base sled and is pressed against one of the reel and the wound roll by the movement of the carrying drum sled.

35. The winding device according to claim 33, further comprising:

a base sled adapted to mount the feed roll and the discharge roll;

a coupling connecting the base sled with the at least one vacuum box; and pivot points located in the coupling, wherein the at least one vacuum box is pivotably mounted around a central axis of the carrying drum and the seal of the vacuum box is retained during the relative movement between the carrying drum and the base sled.

36. A method for winding a material web onto a reel to form a wound roll in an apparatus that includes a rotatable feed roll, a carrying drum movable relative to at least one of the reel and the wound roll and adapted to be pressed against the at least one of the reel and the wound roll, a discharge roll and a pulper, the method comprising:

introducing a material web over a rotating feed roll;

guiding the material web from the rotating feed roll to the carrying drum;

guiding the material over the carrying drum on a support belt;

applying an external vacuum to a circumferential surface of the carrying drum, which is not contacted by the support belt;

moving the carrying drum to press against the at least one of the reel and the wound roll;

forming a winding nip between the carrying drum and the at least one of the reel and the wound roll;

guiding the support belt over the discharge roll, which is located downstream from the carrying drum, relative to the belt run direction, in the vicinity of a pulper;

guiding a leading end of the material web into the pulper; and winding the material web onto the at least one of the reel and the wound roll.

37. The method for winding a material web according to claim 36, wherein the carrying roll has at least one of circumferential ridges and perforations, and the support belt is one of a perforated and an air permeable belt.

38. The method for winding a material web according to claim 37, wherein the carrying drum comprises a perforated jacket.

39. The method for winding a material web according to claim 38, further comprising:

supporting the material web on the support belt; and fixing the material web on the support belt by vacuum.

40. The method for winding a material web according to claim 39, further comprising:

guiding the material web on the feed roll; and picking up the material web with the support belt in the vicinity of the feed roll.

41. The method for winding a material web according to claim 40, further comprising:

guiding the support belt over the feed roll in a pickup vicinity.

42. The method for winding a material web according to claim 36, wherein at least one of the carrying drum and the support belt has a structured surface.

43. The method for winding a material web according to claim 42, wherein the structured surface comprises V-shaped grooves.

44. The method for winding a material web according to claim 42, wherein the support belt is a thin, flexible belt and conforms to the structure of the carrying drum.

45. The method for winding a material web according to claim 36, further comprising:

applying a vacuum from at least one external vacuum box opposite the peripheral vicinity of the carrying drum not contacted by the support belt and the material web; the at least one vacuum box having at least one vacuum port and having sealing elements in the vicinity of the at least one vacuum port contacting the carrying drum.

46. The method for winding a material web according to claim 45, wherein the sealing elements extend crosswise of the web travel direction and are located on opposite sides of the vacuum port, and the sealing elements are doctor blades which make flat contact with the carrying drum.

47. The method for winding a material web according to claim 45, wherein the at least one external vacuum box extends crosswise of the web travel direction at least substantially across the entire width of the machine.

48. The method for winding a material web according to claim 45, further comprising:

applying the vacuum from an internally positioned tube having the at least one vacuum port, the tube being inside the at least one external vacuum box.

49. The method for winding a material web according to claim 48, wherein the internally positioned tube extends at least substantially across the entire width of the winding device.

50. The method for winding a material web according to claim 49, wherein the internally positioned tube has a jacket having the at least one vacuum port on the side of the tube facing the carrying drum.

51. The method for winding a material web according to claim 45, further comprising:

forming a feed side vacuum channel located between the feed roll and the carrying drum, wherein the interior side of the support belt faces a side of the at least one vacuum box and the exterior side of the support belt faces the material web; and applying vacuum through the feed side vacuum channel to the interior side of the support belt in the vicinity between the feed roll and the carrying drum.

52. The method for winding a material web according to claim 51, further bounding the feed side vacuum channel at its front end, as viewed in the web travel direction, by a flexible seal.

53. The method for winding a material web according to claim 45, further comprising:

forming a discharge side vacuum channel located between the discharge roll and the carrying drum, wherein the interior side of the support belt faces a side of the at least one vacuum box and the exterior side of the support belt faces the material web; and applying vacuum through the discharge side vacuum channel to the interior side of the support belt in the vicinity between the carrying drum and the discharge roll.

54. The method for winding a material web according to claim 45, further comprising:

blowing compressed air in the vicinity of the discharge roll to assist the release of the material web from the support belt.

55. The method for winding a material web according to claim 45, further comprising:

forming an edge vacuum zone, located in the vicinity of an end of the carrying drum by subdividing an area enclosed by the carrying drum and the at least one external vacuum box; and applying the vacuum from the edge vacuum zone.

56. The method for winding a material web according to claim 55, wherein the at least one vacuum box further comprises an internally positioned tube for applying vacuum to the edge vacuum zone.

57. The method for winding a material web according to claim 45, further comprising:

moving the discharge roll to feed the leading end of the material web to the pulper; and thereafter moving the discharge roll to feed the material web onto the at least one of the reel and the wound roll.

58. The method for winding a material web according to claim 45, further comprising:

mounting the carrying drum on a base sled;

moving the carrying drum base sled to cause the carrying drum to press against at least one of the reel and the wound roll.

59. The method for winding a material web according to claim 58, wherein the moveable carrying drum base sled is a powered controlled sled.

60. The method for winding a material web according to claim 58, further comprising:

moving the moveable carrying drum base sled to at least partially compensate for an increasing winding diameter of the wound roll.

61. The method for winding a material web according to claim 60, further comprising:

controlling movement of the moveable carrying drum base sled along a predetermined path.

62. The method for winding a material web according to claim 61, further comprising:

positioning the feed roll and the discharge roll so that the support belt and the material web exert a force on the carrying roll that acts at an angle of approximately 90° to the force with which the carrying drum is pressed against one of the reel and the wound roll.

63. The method for winding a material web according to claim 45, further comprising:

mounting the feed roll and the discharge roll on a base sled.

64. The method for winding a material web according to claim 63, further comprising:

pivoting the vacuum box around the axis of the carrying drum; and connecting the base sled with a coupling to the vacuum box at an end remote from the carrying drum.

65. The method for winding a material web according to claim 64, further comprising:

maintaining the seal of the vacuum box during relative movement between the carrying drum and the base sled.

66. The method for winding a material web according to claim 45, wherein the carrying drum is provided with a zone-controlled internal support.

67. The method for winding a material web according to claim 36, further comprising:

applying a vacuum from at least one external vacuum box opposite the peripheral vicinity of the carrying drum not contacted by the support belt and the material web; the at least one vacuum box having at least one vacuum port and having sealing elements in the vicinity of the at least one vacuum port contacting the carrying drum;

applying vacuum from an internally positioned tube having the at least one vacuum port, the tube being inside the at least one external vacuum box;

forming a feed side vacuum channel located between the feed roll and the carrying drum, wherein the interior side of the support belt faces a side of the at least one vacuum box and the exterior side of the support belt faces the material web;

applying vacuum through the feed side vacuum channel to the interior side of the support belt in the vicinity between the feed roll and the carrying drum;

forming a discharge side vacuum channel located between the discharge roll and the carrying drum, wherein the interior side of the support belt faces a side of the at least one vacuum box and the exterior side of the support belt faces the material web;

applying vacuum through the discharge side vacuum channel to the interior side of the support belt in the vicinity between the carrying drum and the discharge roll; and blowing compressed air in the vicinity of the discharge roll to assist the release of the material web from the support belt.

68. The method for winding a material web according to claim 67, further comprising:

mounting the carrying drum on a base sled; and moving the base sled to cause the carrying drum to press against at least one of the reel and the wound roll.

69. The method for winding a material web according to claim 67, further comprising:

mounting the feed roll and the discharge roll on a base sled;

pivoting the vacuum box around the axis of the carrying drum;

connecting the base sled with a coupling to the vacuum box at an end remote from the carrying drum; and maintaining the seal of the vacuum box is maintained during relative movement between the carrying drum and the base sled.

70. A winding device for winding a material web onto a reel to form a wound roll, said winding device comprising:

a feed roll;

a carrying drum;

a support belt being adapted to guide the material web over the feed roll and the carrying drum;

an external vacuum device positioned adjacent a circumferential surface of the carrying drum which is not contacted by the support belt and the material web, wherein the external vacuum device has at least one external vacuum box, at least one vacuum port, and sealing elements located in a vicinity of the at least one vacuum port and coupled with the carrying drum;

a winding nip formed between the carrying drum and the at least one of the reel and the wound roll;

a discharge roll for guiding the support belt, the discharge roll being located in the vicinity of a pulper, and downstream from the carrying drum, relative to a web run direction; and a base sled, wherein the feed roll and the discharge roll are mounted on the base sled; and the discharge roll being adapted to divert at least a portion of the material web to the pulper before feeding the material web to the at least one of the reel and the wound roll.

71. A winding device for winding a material web onto a reel to form a wound roll, said winding device comprising:

a feed roll;

a carrying drum;

a support belt being adapted to guide the material web over the feed roll and the carrying drum;

an external vacuum device positioned adjacent a circumferential surface of the carrying drum which is not contacted by the support belt and the material web;

the external vacuum device including at least one external vacuum box and having at least one vacuum port;

sealing elements in the vicinity of the at least one vacuum port coupled with the carrying drum;

a tube, positioned inside of the at least one vacuum box and connected to a vacuum source;

the at least one external vacuum box including at least one side wall positioned to face the support belt between the feed roll and the support roll;

a feed side vacuum channel located between the feed roll and the carrying drum and formed beneath the surface of the support belt adapted to carry the material web between the interior side of the support belt, the adjacent side wall of the at least one vacuum box near the feed roll, and the carrying drum, the feed side vacuum channel being bounded at its front end as viewed in the web travel direction by a flexible seal and wherein vacuum is applied to the interior side of the support belt through the carrying drum;

the at least one external vacuum box including at least one side wall positioned to face the support belt between the carrying drum and the discharge roll;

a discharge side vacuum channel located between the carrying drum and the discharge roll and formed beneath a surface of the support belt adapted to carry the material web between the interior side of the support belt, the adjacent side wall of the at least one vacuum box near the discharge roll, and the carrying drum, and wherein vacuum is applied to the interior side of the web through the carrying drum;

a winding nip formed between the carrying drum and the at least one of the reel and the wound roll;

a discharge roll for guiding the support belt, the discharge roll being located in the vicinity of a pulper, and downstream from the carrying drum, relative to a web run direction;

a base sled adapted to mount the feed roll and the discharge roll;

a coupling connecting the base sled with the at least one vacuum box; and pivot points located in the coupling, wherein the at least one vacuum box is pivotably mounted around a central axis of the carrying drum and the seal of the vacuum box is retained during the relative movement between the carrying drum and the base sled;

a blowing device located in the vicinity of the discharge roll to assist the release of the material web from the support belt; and the discharge roll being adapted to divert at least a portion of the material web to the pulper before feeding the material web to the at least one of the reel and the wound roll.

72. A method for winding a material web onto a reel to form a wound roll in an apparatus that includes a rotatable feed roll, a carrying drum, a discharge roll and a pulper, the method comprising:

introducing a material web over a rotating feed roll;

guiding the material web from the rotating feed roll to the carrying drum;

guiding the material over the carrying drum on a support belt;

applying an external vacuum to a circumferential surface of the carrying drum, which is not contacted by the support belt;

applying a vacuum from at least one external vacuum box opposite the peripheral vicinity of the carrying drum not contacted by the support belt and the material web; the at least one vacuum box having at least one vacuum port and having sealing elements in the vicinity of the at least one vacuum port contacting the carrying drum;

forming a feed side vacuum channel located between the feed roll and the carrying drum, wherein the interior side of the support belt faces a side of the at least one vacuum box and the exterior side of the support belt faces the material web;

applying vacuum through the feed side vacuum channel to the interior side of the support belt in the vicinity between the feed roll and the carrying drum;

forming a winding nip between the carrying drum and the at least one of the reel and the wound roll;

guiding the support belt over the discharge roll, which is located downstream from the carrying drum, relative to the belt run direction, in the vicinity of a pulper;

guiding a leading end of the material web into the pulper; and winding the material web onto the at least one of the reel and the wound roll.

73. A method for winding a material web onto a reel to form a wound roll in an apparatus that includes a rotatable feed roll, a carrying drum, a discharge roll and a pulper, the method comprising:

introducing a material web over a rotating feed roll;

guiding the material web from the rotating feed roll to the carrying drum;

guiding the material over the carrying drum on a support belt;

applying an external vacuum to a circumferential surface of the carrying drum, which is not contacted by the support belt;

applying a vacuum from at least one external vacuum box opposite the peripheral vicinity of the carrying drum not contacted by the support belt and the material web;

the at least one vacuum box having at least one vacuum port and having sealing elements in the vicinity of the at least one vacuum port contacting the carrying drum;

forming a discharge side vacuum channel located between the discharge roll and the carrying drum, wherein the interior side of the support belt faces a side of the at least one vacuum box and the exterior side of the support belt faces the material web; and applying vacuum through the discharge side vacuum channel to the interior side of the support belt in the vicinity between the carrying drum and the discharge roll;

forming a winding nip between the carrying drum and the at least one of the reel and the wound roll;

guiding the support belt over the discharge roll, which is located downstream from the carrying drum, relative to the belt run direction, in the vicinity of a pulper;

guiding a leading end of the material web into the pulper; and winding the material web onto the at least one of the reel and the wound roll.

74. A method for winding a material web onto a reel to form a wound roll in an apparatus that includes a rotatable feed roll, a carrying drum, a discharge roll and a pulper, the method comprising:

introducing a material web over a rotating feed roll;

guiding the material web from the rotating feed roll to the carrying drum;

guiding the material over the carrying drum on a support belt;

applying an external vacuum to a circumferential surface of the carrying drum, which is not contacted by the support belt;

applying a vacuum from at least one external vacuum box opposite the peripheral vicinity of the carrying drum not contacted by the support belt and the material web; the at least one vacuum box having at least one vacuum port and having sealing elements in the vicinity of the at least one vacuum port contacting the carrying drum;

forming an edge vacuum zone, located in the vicinity of an end of the carrying drum by subdividing an area enclosed by the carrying drum and the at least one external vacuum box;

applying the vacuum from the edge vacuum zone;

forming a winding nip between the carrying drum and the at least one of the reel and the wound roll;

guiding the support belt over the discharge roll, which is located downstream from the carrying drum, relative to the belt run direction, in the vicinity of a pulper;

guiding a leading end of the material web into the pulper; and winding the material web onto the at least one of the reel and the wound roll.

75. A method for winding a material web onto a reel to form a wound roll in an apparatus that includes a rotatable feed roll, a carrying drum, a discharge roll and a pulper, the method comprising:

introducing a material web over a rotating feed roll;

guiding the material web from the rotating feed roll to the carrying drum;

guiding the material over the carrying drum on a support belt;

applying an external vacuum to a circumferential surface of the carrying drum, which is not contacted by the support belt;

applying a vacuum from at least one external vacuum box opposite the peripheral vicinity of the carrying drum not contacted by the support belt and the material web; the at least one vacuum box having at least one vacuum port and having sealing elements in the vicinity of the at least one vacuum port contacting the carrying drum;

forming a winding nip between the carrying drum and the at least one of the reel and the wound roll;

guiding the support belt over the discharge roll, which is located downstream from the carrying drum, relative to the belt run direction, in the vicinity of a pulper;

guiding a leading end of the material web into the pulper;

moving the discharge roll to feed the leading end of the material web to the pulper;

thereafter moving the discharge roll to feed the material web onto the reel; and winding the material web onto the at least one of the reel and the wound roll.

76. A method for winding a material web onto a reel to form a wound roll in an apparatus that includes a rotatable feed roll, a carrying drum, a discharge roll and a pulper, the method comprising:

mounting the feed roll and the discharge roll on a base sled;

introducing a material web over a rotating feed roll;

guiding the material web from the rotating feed roll to the carrying drum;

guiding the material over the carrying drum on a support belt;

applying an external vacuum to a circumferential surface of the carrying drum, which is not contacted by the support belt;

applying a vacuum from at least one external vacuum box opposite the peripheral vicinity of the carrying drum not contacted by the support belt and the material web; the at least one vacuum box having at least one vacuum port and having sealing elements in the vicinity of the at least one vacuum port contacting the carrying drum;

forming a winding nip between the carrying drum and the at least one of the reel and the wound roll;

guiding the support belt over the discharge roll, which is located downstream from the carrying drum, relative to the belt run direction, in the vicinity of a pulper;

guiding a leading end of the material web into the pulper; and winding the material web onto the at least one of the reel and the wound roll.

77. A method for winding a material web onto a reel to form a wound roll in an apparatus that includes a rotatable feed roll, a carrying drum, a discharge roll and a pulper, the method comprising:

introducing a material web over a rotating feed roll;

guiding the material web from the rotating feed roll to the carrying drum;

guiding the material over the carrying drum on a support belt;

applying an external vacuum to a circumferential surface of the carrying drum, which is not contacted by the support belt;

applying a vacuum from at least one external vacuum box opposite the peripheral vicinity of the carrying drum not contacted by the support belt and the material web; the at least one vacuum box having at least one vacuum port and having sealing elements in the vicinity of the at least one vacuum port contacting the carrying drum;

applying vacuum from an internally positioned tube having the at least one vacuum port, the tube being inside the at least one external vacuum box;

forming a feed side vacuum channel located between the feed roll and the carrying drum, wherein the interior side of the support belt faces a side of the at least one vacuum box and the exterior side of the support belt faces the material web;

applying vacuum through the feed side vacuum channel to the interior side of the support belt in the vicinity between the feed roll and the carrying drum;

forming a discharge side vacuum channel located between the discharge roll and the carrying drum, wherein the interior side of the support belt faces a side of the at least one vacuum box and the exterior side of the support belt faces the material web;

applying vacuum through the discharge side vacuum channel to the interior side of the support belt in the vicinity between the carrying drum and the discharge roll;

forming a winding nip between the carrying drum and the at least one of the reel and the wound roll;

guiding the support belt over the discharge roll, which is located downstream from the carrying drum, relative to the belt run direction, in the vicinity of a pulper;

guiding a leading end of the material web into the pulper;

blowing compressed air in the vicinity of the discharge roll to assist the release of the material web from the support belt; and winding the material web onto the at least one of the reel and the wound roll.

* * * * *